US005752455A

United States Patent [19]

Papajewski et al.

[11] Patent Number: 5,752,455

[45] Date of Patent: May 19, 1998

[54] CLUTCH MECHANISM FOR A BUTTONHOLE SEWING MACHINE

[75] Inventors: Rudy Papajewski, deceased, late of Stutensee, by Edith Alice Papajewski, legal representative; Gerd Papajewski, Stutensee, both of Germany

[73] Assignee: AMF Reece, Inc., Mechanicsville, Va.

[21] Appl. No.: 710,954

[22] Filed: Sep. 24, 1996

[51] Int. Cl.[6] ..... D05B 3/06; D05B 69/00

[52] U.S. Cl. ..... 112/67; 112/220; 112/475.25

[58] Field of Search ..... 112/65, 67, 68, 112/271, 220, 446, 448, 449, 475.25; 192/18 R

[56] References Cited

U.S. PATENT DOCUMENTS 4,687,461 8/1987 Palloch et al. ..... 112/220 X 5,067,422 11/1991 Sakuma ..... 112/68

*Primary Examiner*—Peter Nerbun

*Attorney, Agent, or Firm*—James C. Wray; Meera P. Narasimhan

[57] ABSTRACT

A buttonhole sewing machine drive motor is turned on with an on switch. A large foot pedal engages the drive pulley on the motor and drives a V-belt. The V-belt drives a pulley and a timing pulley, which in turn drives a timing belt. The timing belt drives a clutch timing pulley, which freely rotates around a main drive shaft of the buttonhole sewing machine. When a small foot pedal is pressed downward, an air-activated over-the-center toggle connection moves a slide bar which moves a clutch switch spring. Parallel extension on the clutch switch spring move thrust washers and an interposed thrust bearing. The thrust washers compress a clutch disc assembly which engages the clutch timing pulley. A switch bushing is locked to the clutch disc assembly, and brake springs in a hand wheel assembly are locked to the switch bushing. The brake springs engage a hand wheel disc which is connected to a hand wheel and which is connected to an end of the main drive shaft for turning the drive shaft. When the engagement force on the clutch switch spring is removed, the clutch assembly ceases to rotate with the clutch timing pulley, which continues to freely rotate while the drive shaft is stopped. The hand wheel assembly may be used to turn the drive shaft.

10 Claims, 2 Drawing Sheets

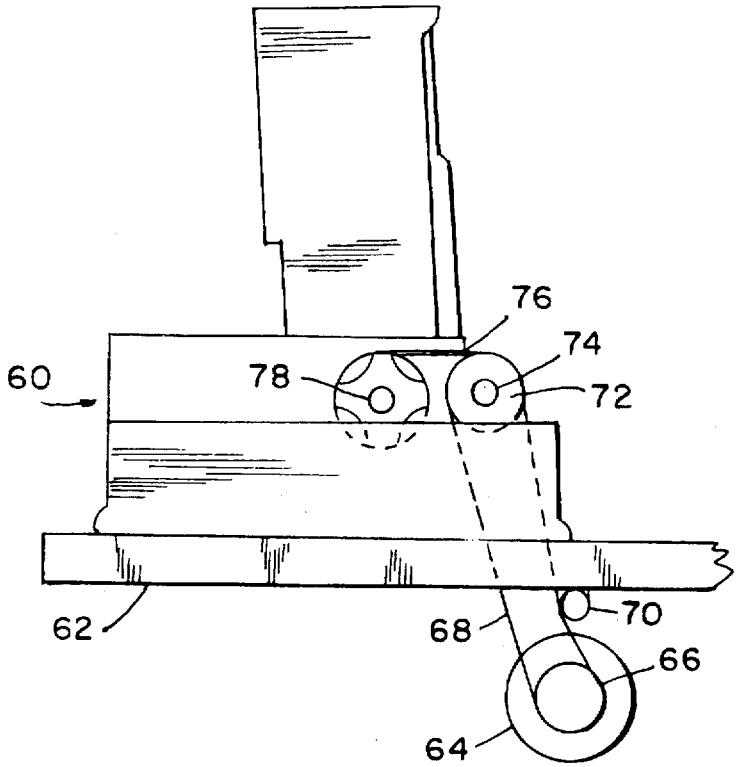
FIG. 2
FIG. 3
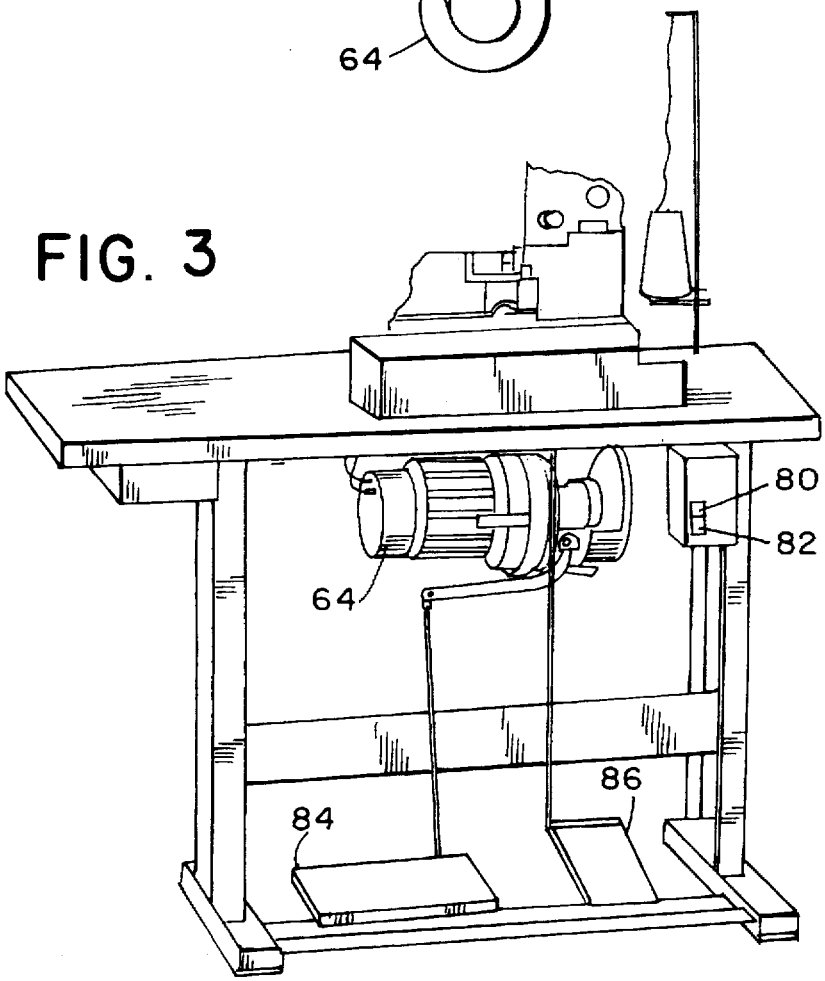

CLUTCH MECHANISM FOR A BUTTONHOLE SEWING MACHINE

BACKGROUND OF THE INVENTION

Buttonhole sewing machines are highly complex. To make sewing buttonholes economical, it is important to run the buttonhole sewing machines at high revolutions. Starting and stopping the machines in short times is important. Equally important are high speed coupling and uncoupling of the buttonhole sewing machine drive shafts to drive sources.

Needs exist for improved clutches which are capable of rapid connection and disconnection in very short times.

SUMMARY OF THE INVENTION

The new clutching system provides both increased productivity and consistency with fast and positive engagement and disengagement of the clutch. The pulley is sandwiched between two clutch faces providing more surface area and greater control. The invention provides a faster and more positive control system than other models which engage more slowly and only use a single clutch surface.

A buttonhole sewing machine drive motor is turned on with an on switch. A large foot pedal engages the drive pulley on the motor and drives a V-belt. The V-belt drives a pulley and a timing pulley, which in turn drives a timing belt. The timing belt drives a clutch timing pulley, which freely rotates around a main drive shaft of the buttonhole sewing machine. When a small foot pedal is pressed downward, an air-activated over-the-center toggle connection moves a slide bar which moves a clutch switch spring. Parallel extensions on the clutch switch spring move thrust washers and an interposed thrust bearing. The thrust washers compress a clutch disc assembly which engages the clutch timing pulley. A switch bushing rotates with the clutch disc assembly, and brake springs in a hand wheel assembly are locked to the switch bushing. The brake springs engage a hand wheel disc which is connected to a hand wheel and which is connected to an end of the main drive shaft for turning the drive shaft. When the engagement force on the clutch switch spring is removed, the clutch assembly ceases to rotate with the clutch timing pulley, which continues to freely rotate while the drive shaft is stopped. The hand wheel assembly may be used to turn the drive shaft for adjustment purposes.

A preferred buttonhole sewing machine clutch has a hinge block assembly which is connected to the machine and extends around a drive shaft. A clutch switch spring is positioned around a drive shaft and is movable within a channel in the hinge block assembly. Thrust washers surround the drive shaft, and a thrust bearing is interposed between the washers around the drive shaft. A disc assembly is positioned around the drive shaft next to the thrust washers. A switch bushing is connected to the disc assembly for rotation with the disc assembly. A clutch timing pulley has a central needle bearing positioned around the switch bushing for rotating on the switch bushing. A hand wheel assembly is positioned around the drive shaft and the switch bushing. The hand wheel assembly has a large hand wheel. Brake springs are connected to the switch bushing for turning therewith. A hand wheel disc is mounted on an end of the drive shaft. The brake springs rotationally connect the hand wheel disc to the switch bushing for rotating the main drive shaft when the disc assembly is engaged by the clutch switch spring.

A preferred clutch mechanism for a buttonhole sewing machine has a hand wheel disc connected with set screws to an end of a drive shaft. Brake springs are mounted on the drive shaft next to the hand wheel disc. A hand wheel surrounds the drive shaft and the brake springs and hand wheel disc, and is connected to the hand wheel disc for rotation with the hand wheel disc. A clutch timing pulley is freely rotatable on the main drive shaft and is positioned thereon spaced inward from the hand wheel assembly. A needle bearing is located within the clutch timing pulley. A switch bushing has a radial collar and one end extending from the radial collar through the needle bearing and into the hand wheel assembly, and is connected with the brake springs for turning with the brake springs. The switch bushing has a second end extending oppositely to the first end from the collar. A clutch disc assembly is mounted on the second end of the switch bushing for rotating therewith. Thrust washers surround the drive shaft next to the clutch disc assembly, and a thrust bearing surrounds the drive shaft amid the thrust washers. A clutch switch spring has extensions contacting the thrust washers for moving the thrust washers toward the clutch disc assembly. A hinge block assembly has side lobes and a central recess for mounting the clutch switch spring.

A preferred method of operably connecting a sewing machine main drive shaft to a motor driven clutch timing pulley includes continuously driving the clutch timing pulley with the motor in a uniform direction. The buttonhole sewing machine drive shaft is immediately connected or disconnected from rotation with the clutch timing pulley by deflecting a clutch switch spring. Parallel extensions on the clutch switch spring are pressed against thrust washers surrounding the main drive shaft. A thrust bearing surrounding the main drive shaft supports the thrust washers. The thrust washers are pressed against a disc assembly, the disc assembly is pressed into contact with the clutch timing pulley, and the clutch timing pulley is pushed into contact with the hand wheel, thereby turning the disc assembly with the clutch timing pulley, turning a switch bushing with the clutch disc assembly and extending the switch bushing and supporting the switch bushing for relative rotation within the clutch timing pulley. Brake springs are moved in a hand wheel assembly with the switch bushing and locking a hand wheel disc within the hand wheel assembly to the brake springs, and driving the main drive shaft with the hand wheel disc.

These and further and other objects and features of the invention are apparent in the disclosure, which includes the above and ongoing written specification, with the claims and the drawings.

BRIEF DESCRIPTION OF THE DRAWINGS

FIG. 2 shows drive connection of a buttonhole sewing machine mounted on a table.

FIG. 3 shows operating controls for the buttonhole sewing machine.

DETAILED DESCRIPTION OF THE PREFERRED EMBODIMENTS

Figure 1:
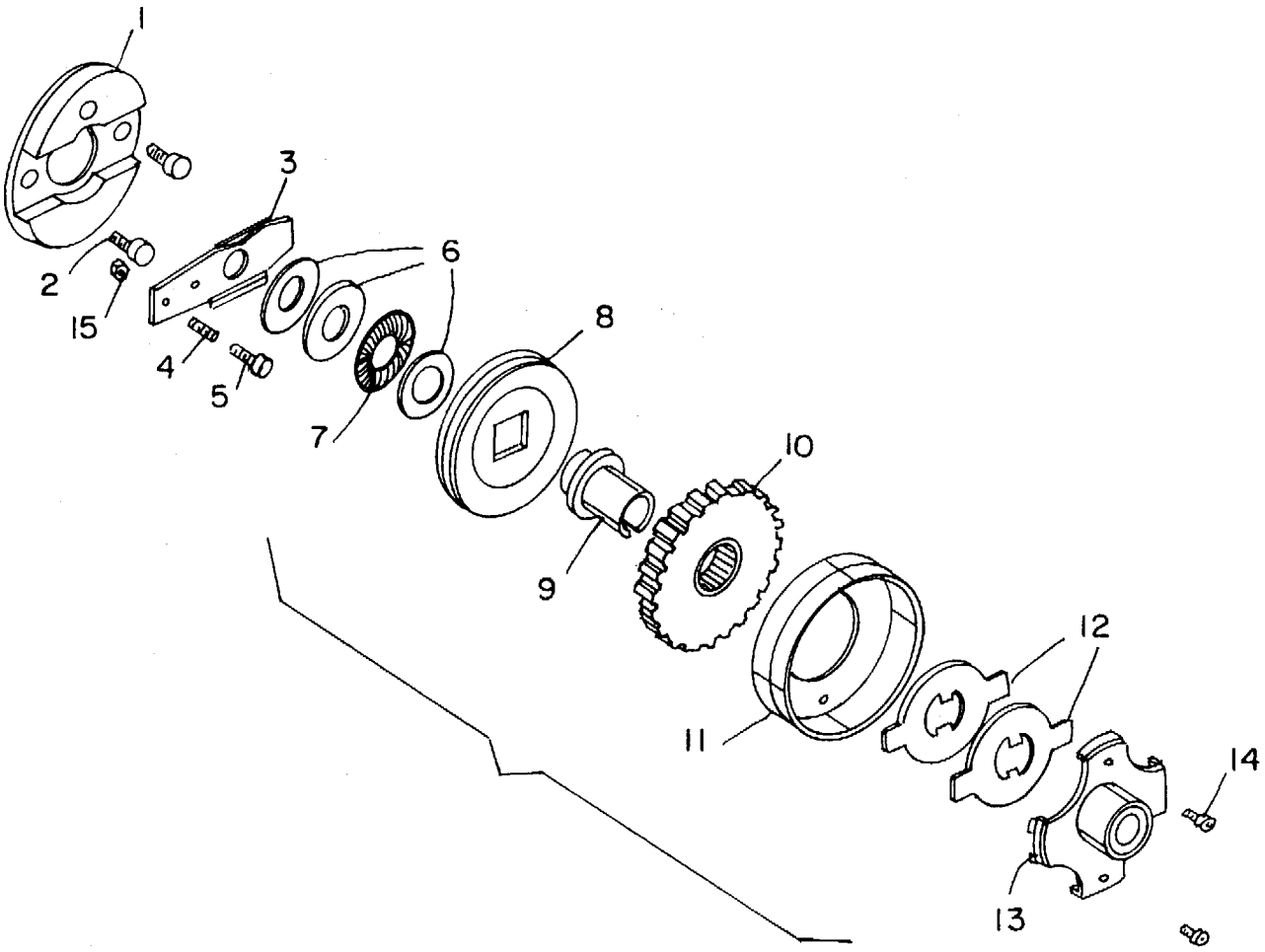
FIG. 1 shows the preferred clutch mechanism for a buttonhole sewing machine.

FIG. 1 shows the preferred clutch mechanism for a buttonhole sewing machine. A hinge block assembly 1 is mounted on the sewing machine with two screws 2. A clutch switch spring lever 3 is positioned within the central slot in the hinge block assembly 1. An adjusting screw 5 is mounted with a spring 4 and a nut 15 on one end of the clutch switch spring 3. Thrust washers 6 are controlled by the clutch spring, and particularly by the tapered extensions in the center of the clutch spring. A thrust bearing 7 separates the thrust washers 6 so that the washers on the left may remain stationary or turn slowly while the washer or washers on the right turn with the clutch disc assembly 8. A clutch switch bushing 9 has a radial collar and a left hand portion which fits within the clutch aperture in the center disc of the clutch disc assembly 8. The clutch switch bushing 9 is free to rotate with the clutch assembly 8 on the main drive shaft of the sewing machine when the clutch is disengaged.

A clutch timing pulley 10 constantly rotates when the drive pulley on the motor is engaged. The right hand side of the switch bushing 9 extends through the center of the clutch timing pulley 10. A needle bearing in the center of the clutch timing pulley 10 allows the clutch timing pulley 10 to freely rotate around the bushing 9 and vice versa.

Pressure to the right applied on the clutch switch spring 3 presses the thrust bearings 6 to the right, which in turn presses the disc assembly 8 to the right into contact with the left face of the clutch timing pulley 10. The clutch timing pulley moves to the right and engages the face of hand wheel 11. Brake springs 12 are keyed on the clutch switch bushing 9. The brake springs engage a hand wheel disc 13 which is fixed to an end of the drive shaft with set screws. That locks up the clutch assembly and causes the clutch disc assembly 8, the clutch switch bushing 9 and the main drive shaft to rotate with the clutch timing pulley 10.

The hand wheel assembly 11 allows the movement of the sewing machine main drive shaft when the clutch timing pulley 10 is not turning because the power is turned off, or when the clutch assembly 8 is disengaged from the clutch timing pulley 10. Hand wheel brake springs 12 are keyed to the right portion of the switch bushing 9. The hand wheel disc 13 is attached to the hand wheel with screws 14. The hand wheel disc 13 is secured on the end of the main drive shaft with set screws. The brake springs 12 brake the switch bushing 9 with the hand wheel disc 13 and the hand wheel assembly 11 so that the main drive shaft turns with the switch bushing 9 when actuation of the clutch switch spring 3 to the right presses on the thrust washer 6, engaging the clutch disc assembly 8 with the clutch timing pulley 10. The engaged clutch assembly 8 drives the switch bushing 9 and the main shaft. The hand wheel assembly 11, the brakes 12 and hand wheel disc 13 also drive the main shaft.

As shown in FIG. 2, a sewing machine 60 is mounted on a table 62. A motor 64 is adjustably mounted beneath the table to drive a pulley 66 and a V-belt 68. An idler 70 keeps the V-belt away from a table slot. Tension of the V-belt is adjusted by adjusting the motor mount. The V-belt drives a pulley 72 on a stub or jack shaft 74. A timing pulley is connected to the pulley 72 which together rotate with needle bearings on shaft 74 and drive a timing belt 76, which drives the clutch timing pulley 10 on the main drive shaft 78.

When the clutch is disengaged, a 0.6 mm air gap is maintained between the clutch timing pulley 10 and the hand wheel 11 to make sure that there is no friction drive between the clutch timing pulley 10 and the hand wheel 11.

Sewing machine controls are shown in FIG. 3. An "on" button 80 is pushed to supply power to motor 64. An "off" button 82 turns off the power to the motor. The toe of the large foot pedal 84 is pushed and latched, and that supplies rotational power through the pulley 66 and V-belt 68 and timing belt 76 to clutch timing pulley 10 on the sewing machine 60. When the large foot pedal 84 is heeled, a brake is applied and motion of the pulley 66 and V-belt 68 cease, stopping application of power to the clutch timing pulley 10 on the sewing machine, even when the machine is in mid-cycle. When the motor is turned on by pressing the "on" button, if the "off" button had been previously pressed, or by pressing the toe of the large pedal 84 when the machine was stopped in mid-cycle, the machine will continue to the home position and then stop. Heeling the large foot pedal 84 stops the pulleys from rotating and the machine from sewing, but power to the motor remains on. The drive pulley 66 of the motor is disengaged until the large pedal is toed.

After the large pedal is toed or toed and latched, and when the small pedal 86 is pressed all the way down, the machine sews through one cycle and stops. Activating the small foot pedal by pressing it all the way down causes an air cylinder and toggle to slide a bar and stop/start pin to push the lower extended end of the clutch spring 3 to the right. The clutch spring 3 presses on the thrust washers, engaging the clutch disc assembly 8 and the clutch timing pulley 10 to start the machine. Starting the machine drops and locks the workpiece clamps, starts the machine sewing a buttonhole, cuts the buttonhole, trims the thread, stops the machine and automatically unlocks and lifts the clamps. The machine automatically clamps the material, sews and cuts the buttonhole, trims the thread and stops with clamps in a raised position, ready for starting the next buttonhole. The key to starting the machine and automatically cycling the machine through one complete buttonhole is activating the clutch, which occurs by pressing all the way down on the small foot pedal 86.

While the invention has been described with reference to specific embodiments, modifications and variations of the invention may be constructed without departing from the scope of the invention, which is defined in the following claims.

We claim:

1. A buttonhole sewing machine clutch comprising a hinge block assembly adapted to be connected to the machine and extend around a drive shaft, a clutch switch spring adapted to be positioned around the drive shaft and movable within a channel in the hinge block assembly, thrust washers adapted to surround the drive shaft and a thrust bearing interposed between the washers around the drive shaft, a disc assembly adapted to be positioned around the drive shaft next to the thrust washers, a switch bushing rotatably connected to the disc assembly for rotation with the disc assembly, a clutch timing pulley positioned around the switch bushing and having a central needle bearing for receiving the switch bushing, a hand wheel assembly adapted to be positioned around the drive shaft and the switch bushing, the hand wheel assembly having a large hand wheel and having brake springs connected to the switch bushing for turning therewith, and a hand wheel disc adapted to be mounted on an end of the drive shaft, the brake springs connecting the hand wheel disc to the switch bushing for rotating the main drive shaft when the disc assembly is engaged by the clutch switch spring.

2. The apparatus of claim 1, wherein the hinge block assembly has two segmental lobes adapted to be connected to the buttonhole sewing machine, and wherein the channel comprises a central rectangular channel between the lobes.

3. The apparatus of claim 1, further comprising a clutch face on the hand wheel facing the clutch timing pulley for engagement with the pulley.

4. The apparatus of claim 1, wherein the brake springs brake the switch bushing to the hand wheel disc for turning the drive shaft through the switch bushing.

5. A clutch mechanism for a buttonhole sewing machine, comprising a hand wheel disc adapted to be connected to an end of a drive shaft, brake springs adapted to be mounted on the drive shaft next to the hand wheel disc, a hand wheel adapted to surround the drive shaft and surrounding the brake springs and hand wheel disc and connected to the hand wheel disc for rotation with the hand wheel disc, a clutch timing pulley adapted to freely rotate on the main drive shaft and be positioned thereon spaced inward from the hand wheel assembly, a needle bearing within the clutch timing pulley, a switch bushing having a radial collar and having one end extending from the radial collar through the needle bearing and into the hand wheel assembly and therein connected with the brake springs for turning with the brake springs, the switch bushing having a second end extending oppositely to the first end from the collar, and a clutch disc assembly mounted on the second end of the switch bushing for rotating therewith, thrust washers adapted to surround the drive shaft next to the clutch disc assembly and a thrust bearing adapted to surround the drive shaft amid the thrust washers, a clutch switch spring having extensions contacting the thrust washers for moving the thrust washers toward the clutch disc assembly, and a hinge block assembly for mounting the clutch switch spring.

6. The apparatus of claim 5, wherein the extension comprise parallel triangular elements which extend axially from sides of the switch spring, and wherein the triangular elements have apexes which press on sides of the thrust washers.

7. The method of operably connecting a buttonhole sewing machine main drive shaft to a motor-driven clutch timing pulley, comprising continuously driving the clutch timing pulley with the motor in a uniform direction, rapidly connecting and disconnecting the buttonhole sewing machine drive shaft from rotation with the clutch timing pulley by deflecting a clutch switch spring, pressing parallel axial extensions on the clutch switch spring against thrust washers surrounding the main drive shaft, separating and relatively rotating the thrust washers with a thrust bearing surrounding the main drive shaft and interposed between the thrust washers, pressing the thrust washers against a disc assembly, pressing the disc assembly into contact with the clutch timing pulley, thereby turning the disc assembly with the clutch timing pulley, turning a switch bushing with the clutch disc assembly and extending the switch bushing and supporting the switch bushing for relative rotation within the clutch timing pulley, rotating brake springs in a hand wheel assembly with the switch bushing and locking a hand wheel disc within the hand wheel assembly to the brake springs, and driving the main drive shaft with the hand wheel disc.

8. The method of claim 7, further comprising axially moving the clutch timing pulley into facial engagement with a hand wheel upon moving the clutch switch spring thrust washers and clutch disc assembly toward the clutch timing pulley.

9. The method of claim 7, further comprising turning a switch bushing with the clutch disc assembly and extending the switch bushing and supporting the switch bushing for relative rotation within the clutch timing pulley.

10. The method of claim 9, further comprising rotating brake springs in a hand wheel assembly with the switch bushing and locking a hand wheel disc within the hand wheel assembly to the brake springs, and driving the main drive shaft with the hand wheel disc.

* * * * *